US006440216B1

(12) United States Patent
Aschenbeck

(10) Patent No.: US 6,440,216 B1
(45) **Date of Patent: *Aug. 27, 2002**

(54) APPARATUS FOR DEPOSITING GRANULES ONTO AN ASPHALT COATED SHEET

(75) Inventor: David P. Aschenbeck, Newark, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/468,401

(22) Filed: Dec. 20, 1999

(51) Int. Cl.[7] ..... B05C 19/00

(52) U.S. Cl. ..... 118/308; 118/322; 118/324; 427/180; 427/186; 427/188

(58) Field of Search ..... 118/200, 308, 118/322, 324, 325; 427/180, 186, 188, 127, 128, 191, 199

(56) References Cited

U.S. PATENT DOCUMENTS

| | | | |
|---|---|---|---|
| 2,037,822 | A | 4/1936 | Robert |
| 2,728,685 | A | 12/1955 | Muench |
| 3,730,397 | A | 5/1973 | Magnus |
| 5,037,671 | A | 8/1991 | Karna |
| 5,048,453 | A | 9/1991 | Eriksson |
| 5,382,291 | A | 1/1995 | Olioso |
| 5,415,717 | A | 5/1995 | Perneborn |
| 5,746,830 | A | 5/1998 | Burton et al. |
| 5,795,389 | A | 8/1998 | Koschitzky |
| 5,814,369 | A | 9/1998 | Bockh et al. |

FOREIGN PATENT DOCUMENTS

| | | | |
|---|---|---|---|
| DE | 3028864 | A1 | 3/1982 |
| DE | 3144617 | A1 | 5/1983 |
| DE | 19518817 | A1 | 11/1996 |
| GB | 2047126 | A | 11/1980 |
| WO | WO01/43886 | A1 | 6/2001 |

*Primary Examiner*—Laura Edwards
*Assistant Examiner*—Y. T. Tadesse
(74) *Attorney, Agent, or Firm*—Inger H. Eckert; James J. Dottavio

(57) ABSTRACT

A method of applying blend drop granules to an asphalt coated sheet includes moving an asphalt coated sheet in a machine direction, generating vertically moving blend drops of granules and directing the vertically moving blend drops of granules into contact with a curved conveyor. The blend drops are moved along the curved conveyor to change the direction of the blend drops of granules to a generally horizontal orientation in the machine direction. The blend drops are released from the curved conveyor for contact with the asphalt coated sheet.

22 Claims, 6 Drawing Sheets

APPARATUS FOR DEPOSITING GRANULES ONTO AN ASPHALT COATED SHEET

TECHNICAL FIELD AND INDUSTRIAL APPLICABILITY OF THE INVENTION

This invention relates to asphalt-based roofing materials, and in particular to depositing protective and decorative shingle granules onto an asphalt coated sheet, for such uses as asphalt strip shingles.

BACKGROUND OF THE INVENTION

Asphalt-based roofing materials, such as roofing shingles, roll roofing and commercial roofing, are installed on the roofs of buildings to provide protection from the elements, and to give the roof an aesthetically pleasing look. Typically, the roofing material is constructed of a substrate such as a glass fiber mat or an organic felt, an asphalt coating on the substrate, and a surface layer of granules embedded in the asphalt coating.

A common method for the manufacture of asphalt shingles is the production of a continuous sheet of asphalt material followed by a shingle cutting operation which cuts the material into individual shingles. In the production of asphalt sheet material, either a glass fiber mat or an organic felt mat is passed through a coater containing hot liquid asphalt to form a tacky, asphalt coated sheet. Subsequently, the hot asphalt coated sheet is passed beneath one or more granule applicators which discharge protective and decorative surface granules onto portions of the asphalt sheet material.

In the manufacture of colored shingles, two types of granules are typically employed. Headlap granules are granules of relatively low cost used for the portion of the shingle which will be covered up on the roof. Colored granules or prime granules are of relatively higher cost and are-applied to the portion of the shingle that will be exposed on the roof.

To provide a color pattern of pleasing appearance, the colored portion of the shingles may be provided with areas of different colors. Usually the shingles have a background color and a series of granule deposits of different colors or different shades of the background color. A common method for manufacturing the shingles is to discharge blend drops onto spaced areas of the tacky, asphalt coated sheet. Background granules are then discharged onto the sheet and adhere to the tacky, asphalt coated areas of the sheet between the granule deposits formed by the blend drops. The term "blend drop", as used herein, refers to the flow of granules of different colors or different shades of color (with respect to the background color) that is discharged from a granule blend drop applicator onto the asphalt coated sheet. The patch or assemblage of the blend drop granules on the asphalt coated sheet is also referred to as the "blend drop".

One of the problems with conventional granule application equipment is that it depends on mechanical movement to discharge blend drops onto the moving asphalt coated sheet. Usually the granules are fed from a hopper by means of a fluted roll from which, upon rotation, the granules are discharged onto the sheet. The roll is ordinarily driven by a drive motor, and the roll is positioned in the drive or non-drive position by means of a brake-clutch mechanism. The requirement for mechanical action has inherent limitations which prevent a very precise beginning and ending to the blend drop. Also, once the mechanical action takes place, there is a short time lag as the inertia of the granules is overcome. Consequently, there is a limit to the sharpness of the blend drops on the shingle. As shingle manufacturing lines go up in speed, the lack of sharpness is accentuated and the distinction between the blend drop granule deposits, and the background color becomes fuzzy. The lack of sharpness puts a severe limitation on the kinds of patterns and color contrasts that can be applied to shingles at high production speeds.

A known granule depositing method designed to overcome the sharpness problem of conventional granule applicators is shown in U.S. Pat. No. 5,795,389 issued to Koschitzky, which is hereby incorporated by reference in its entirety. The Koschitzky reference discloses an auxiliary belt onto which a series of patches of granules is deposited. The auxiliary belt is positioned above the asphalt coated sheet, and includes an upper flight and a lower flight, with the upper flight travelling in a direction opposite that of the asphalt coated sheet. At the upstream end of the auxiliary belt (i.e., upstream with respect to the movement of the asphalt coated sheet) the upper flight of the auxiliary belt turns around a belt roller to form the lower flight. A retaining conveyor is wrapped around the upstream end of the auxiliary conveyor to keep the granules from flying about as the granules are turned into a downward direction. The granules of each of the patches are dropped vertically straight down onto the asphalt coated sheet to form blend drops. After the blend drops are applied to the asphalt coated sheet the background granules are applied to form a granule coated sheet, which is then cooled and cut into individual granule coated shingles. The Koschitzky patent also discloses that a shroud, instead of a retaining conveyor, can be used to direct the granules into a downwardly directed vertical stream of granules.

While the retaining conveyor disclosed in the Koschitzky patent is able to successfully turn down the granules from the auxiliary conveyor, as the vertically moving granules make impact with the moving asphalt coated sheet, a significant portion of the granules bounces on the sheet, landing downstream and thereby causing fuzzy blend drop edges rather than sharply defined leading and trailing edges for the blend drop. This problem is magnified when the asphalt coated sheet is operated at high speeds.

U.S. Pat. No. 5,814,369 to Bockh et al. discloses another blend drop granule applicator having an applicator roll positioned to rotate directly above a moving asphalt coated sheet. The Bockh et al. reference is hereby incorporated by reference in its entirety. Granules corresponding to a desired blend drop are deposited onto the applicator roll at the top of the rotation, and when the applicator roll rotates approximately 180 degrees the blend drop falls off onto the asphalt coated sheet when the blend drop reaches the bottom of the rotation. A media retaining belt engages the applicator roll, contacting and wrapping around the applicator roll to hold the blend drop granules on the surface of the applicator roll until the applicator roll rotates about 180 degrees. At the point where the media retaining belt stops contacting or becomes disengaged from the applicator roll, the blend drop granules are released to drop onto the moving asphalt coated sheet to form the blend drop. The Bockh et al. patent states that the distance that the granules fall from the applicator roll to the asphalt coated sheet should be minimized. The Bockh et al. patent further states that the linear velocity of the applicator roll should be synchronized with that of the moving asphalt coated sheet so that the granules can be dropped precisely in the desired pattern.

It would be advantageous if there could be developed a shingle blend drop technique that enables blend drops to be accurately placed on a moving asphalt coated sheet with sharply defined edge definition at high operating speeds.

SUMMARY OF THE INVENTION

The above objects as well as other objects not specifically enumerated are achieved by a method of applying blend drop granules to an asphalt coated sheet comprising moving an asphalt coated sheet in a machine direction, and depositing blend drops of granules on a blend drop conveyor that is positioned above the asphalt coated sheet. The blend drop conveyor has an upper flight moving in a direction opposite the machine direction and a lower flight moving in the machine direction. The blend drops are moved from the upper flight to the lower flight of the blend drop conveyor while retaining the blend drops in contact with the blend drop conveyor. The blend drops are conveyed in the machine direction while maintaining the blend drops in contact with the blend drop conveyor. The blend drops are released from the blend drop conveyor for contact with the asphalt coated sheet.

According to this invention, there is also provided apparatus for applying blend drop granules to an asphalt coated sheet comprising a blend drop conveyor for receiving blend drop granules. The blend drop conveyor is positioned above an asphalt coated sheet traveling in a machine direction, and has an upper flight moving in a direction opposite the machine direction and a lower flight moving in the machine direction. An alignment preserving mechanism moves the blend drops from the upper flight to the lower flight of the blend drop conveyor while retaining the blend drops in contact with the blend drop conveyor. A conveyor conveys the blend drops in the machine direction while maintaining the blend drops in contact with the blend drop conveyor, and releases the blend drops onto the asphalt coated sheet.

According to this invention, there is also provided a method of applying blend drop granules to an asphalt coated sheet comprising moving an asphalt coated sheet in a machine direction and depositing blend drops of granules on a blend drop conveyor that is generally horizontally oriented and is positioned above the asphalt coated sheet. The blend drops are moved on the conveyor in the machine direction, and are released from the blend drop conveyor for contact with the asphalt coated sheet.

According to this invention, there is also provided a method of applying blend drop granules to an asphalt coated sheet comprising moving an asphalt coated sheet in a machine direction, generating vertically moving blend drops of granules and directing the vertically moving blend drops of granules into contact with a curved conveyor. The blend drops are moved along the curved conveyor to change the direction of the blend drops of granules to a generally horizontal orientation in the machine direction. The blend drops are released from the curved conveyor for contact with the asphalt coated sheet.

According to this invention, there is also provided apparatus for applying blend drop granules to an asphalt coated sheet comprising a blend drop applicator for generating vertically moving blend drops of granules. A curved conveyor is positioned to intercept the vertically moving blend drops of granules and change the direction of the blend drops to a generally horizontal orientation as the blend drops move along the curved conveyor, the curved conveyor being adapted to release the blend drops onto the asphalt coated sheet.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
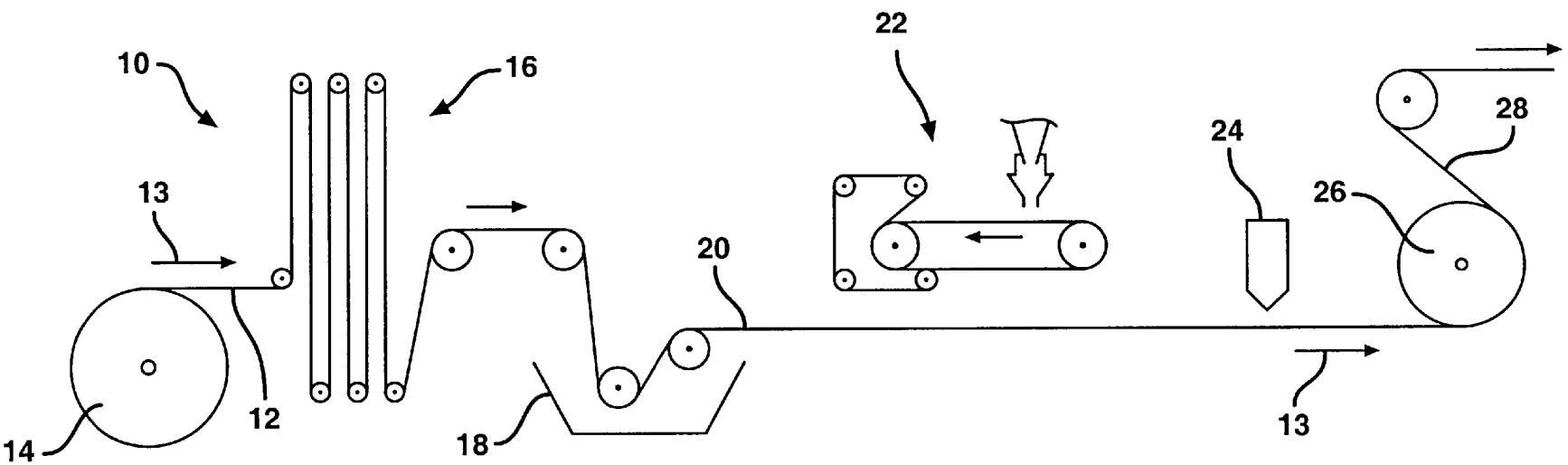
FIG. 1 is a schematic view in elevation of apparatus for manufacturing an asphalt-based roofing material according to the invention.

Referring now to the drawings, there is shown in FIG. 1 an apparatus 10 for manufacturing an asphalt-based roofing material according to the invention. The illustrated manufacturing process involves passing a continuous sheet 12 in a machine direction 13 through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute).

In a first step of the manufacturing process, the continuous sheet 12 of substrate is payed out from a roll 14. The substrate can be any type known for use in reinforcing asphalt-based roofing materials, such as a web, scrim or felt of fibrous materials such as mineral fibers, cellulose fibers, rag fibers, mixtures of mineral and synthetic fibers, or the like. Combinations of materials can also be used in the substrate. Preferably, the substrate is a nonwoven wet process mat or web of glass fibers.

The sheet of substrate is passed from the roll through an accumulator 16. The accumulator allows time for splicing one roll of substrate to another, during which time substrate within the accumulator is fed to the manufacturing process so that the splicing does not interrupt manufacturing.

Next, the sheet is passed through a coater 18 where an asphalt coating is applied to the sheet to form an asphalt coated sheet 20. The asphalt coating can be applied in any suitable manner. In the illustrated embodiment, the sheet is submerged in a supply of hot, melted asphalt coating to completely saturate and cover the sheet with the tacky coating. However, in other embodiments, the asphalt coating could be sprayed on, rolled on, or applied to the sheet by other means. When an organic felt is used as the substrate, it may be desirable to first saturate the felt with a saturant asphalt, and then coat the upper and lower surfaces of the felt with an asphalt coating containing a filler.

The term "asphalt coating" means any type of bituminous material suitable for use on a roofing material, such as asphalts, tars, pitches, or mixtures thereof. The asphalt can be either a manufactured asphalt produced by refining petroleum or a naturally occurring asphalt. The asphalt coating can include various additives and/or modifiers, such as inorganic fillers or mineral stabilizers, organic materials such as polymers, recycled streams, or ground tire rubber. Preferably, the asphalt coating contains an asphalt and an inorganic filler or mineral stabilizer.

The asphalt-coated sheet 20 is passed beneath a blend drop application station indicated generally at 22, where blend drop granules are applied to the asphalt coated sheet. Although only one blend drop application station 22 is shown, it is to be understood that several blend drop application stations can be used. Also, the blend drop application station 22 can be adapted to supply several streams of blend drops, or blend drops of different colors, shading or size.

The asphalt coated sheet 20 is then passed beneath a background granule dispenser 24 for the application of background granules. After the introduction of the background granules, the sheet is turned around a slate drum 26 to press the granules into the asphalt coating and to temporarily invert the sheet. The granule coated sheet 28 is then cooled, cut and packaged in any suitable manner, not shown. The cooling cutting and packaging operations are well known in the art.

Figure 2:
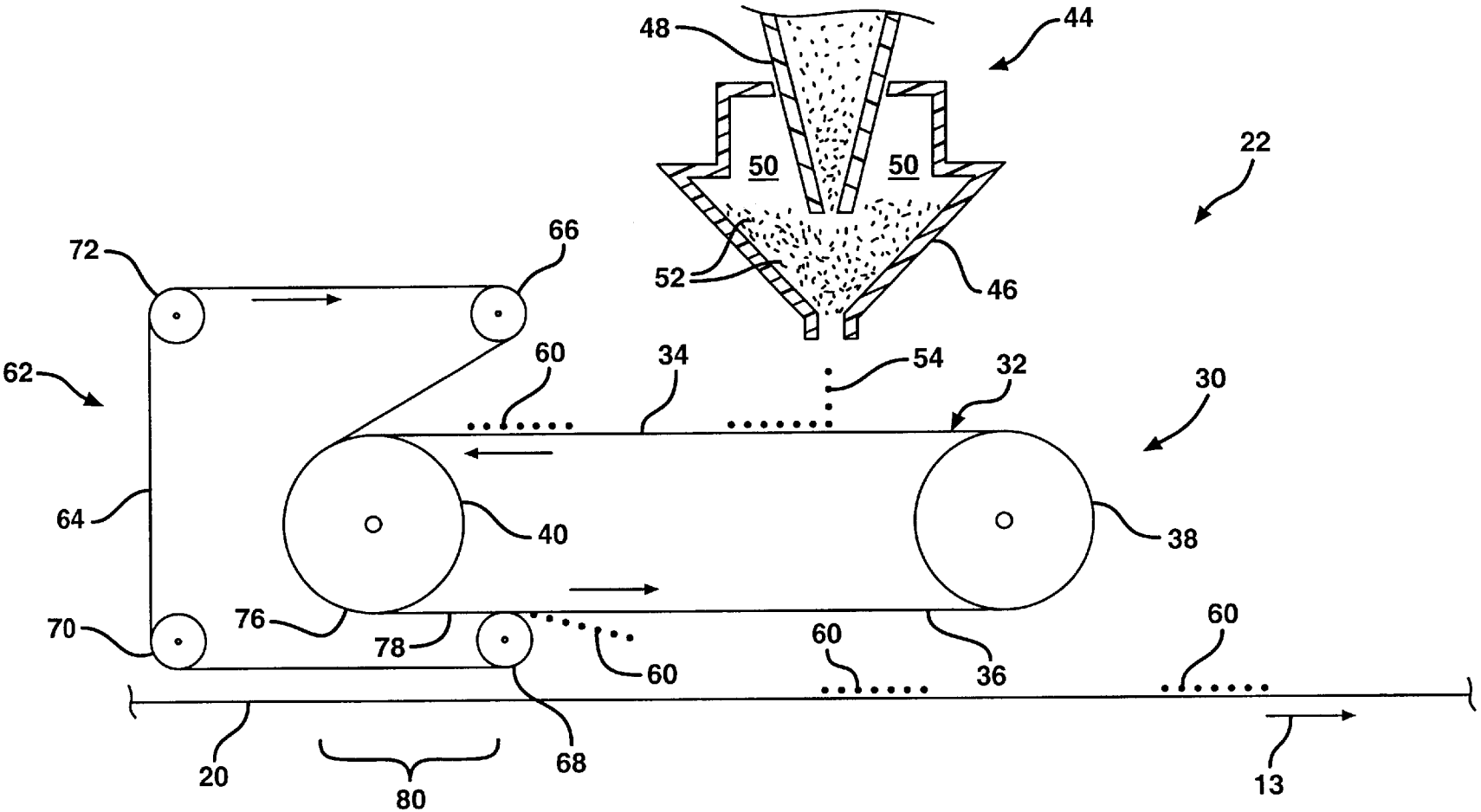
FIG. 2 is an enlarged schematic view in elevation of the blend drop portion of the apparatus of FIG. 1, partially cut away.

As shown in FIG. 2, the blend drop application station 22 includes a blend drop conveyor 30 having a belt 32 with an upper flight 34 and a lower flight 36. The belt 32 travels around a forward roller 38 and a rear roller 40 which separate or space apart the upper flight 34 and the lower flight 36. The blend drop conveyor is operated by a motor, not shown, with the upper flight 34 traveling in a direction opposite the machine direction 13, and the lower flight 36 traveling in the machine direction 13. Both the upper and lower flights 34 and 36 are in planes that are generally parallel to the plane of the asphalt coated sheet 20.

Positioned above the upper flight is a blend drop applicator 44, shown in cross section, which includes a nozzle 46 and a hopper 48. A pneumatic device, not shown, changes the pressure in the air chamber 50 to instantaneously start and stop the flow of granules 52 from the nozzle 46. The pneumatically assisted blend drop applicator 44 is disclosed in more detail in U.S. Pat. No. 5,746,830 to Burton et al., which is hereby incorporated by reference in its entirety. The opening of the nozzle 46 causes a flow or stream of granules 54 to drop toward the upper flight 34. The nozzle is controlled to allow the flow of granules to have a definite or finite beginning and ending, and the resulting collection or assemblage of granules on the upper flight is a blend drop 60.

In order to place the blend drops 60 onto the asphalt coated sheet 20, the conveyor belt 32 travels around the rear roller 40, moving the blend drops 60 from the upper flight 34 to the lower flight 36. While the blend drops 60 are being turned around the rear roller 40, the blend drops are maintained in contact with the blend drop conveyor 30 by means of the alignment preserving conveyor 62. The alignment preserving conveyor 62 shown in the drawings is a preferred embodiment, but it is to be understood that any alignment preserving mechanism that retains the blend drop in contact with the blend drop conveyor can be used.

It can be seen in FIG. 2 that the alignment preserving conveyor 62 is partially wrapped around the rear roller 40. The alignment preserving conveyor 62 includes an alignment belt 64 and an alignment roller 66 that directs the alignment belt 64 into engagement with the blend drop belt 32 and, indirectly, with the rear roller 40. The alignment preserving conveyor 62 also includes a release roller 68 that extends the alignment belt 64 to a position that is somewhat forward of the rear roller 40. Lower and upper return rollers 70 and 72 complete the loop for the belt 64 of the alignment conveyor 62. The alignment conveyor can be powered by driving any one or more of the rollers 66, 68, 70 or 72, or merely by the contact with the blend drop belt 32 and the rear roller 40.

As the alignment belt 64 travels from the lowest point 76 on the rear roller 40 to the release roller 68, the alignment belt is moving in a generally horizontal leg 78. While the blend drop 60 is traversing the horizontal leg 78 the blend drop granules are being conveyed in the machine direction, and they are in a plane substantially parallel with the asphalt coated sheet 20. After the blend drops pass the release roller 68, the blend drops 60 are released from contact with the blend drop conveyor 30, and the blend drop falls to the asphalt coated sheet 20. The conveying of the blend drops in the machine direction 13 can be at any desired speed: equal to, greater than or less than the speed of the asphalt coated sheet 20. To result in the sharpest definition of the edges of the blend drop on the asphalt coated sheet, it may be advantageous for the blend drop to be released from the blend drop conveyor at a speed that approximates the speed of the asphalt coated sheet. Also, for minimal distortion of the shape of the blend drop 60 after it is released, the release roller 68 is preferably as small as possible to enable the blend drop to be released as close as possible to the moving asphalt coated sheet 20.

An advantage in employing the horizontal leg 78 is that the blend drop 60 is conveyed for a significant distance in the machine direction 13 before the blend drop is released. This ensures that the granules have momentum in the machine direction before being released. In one embodiment of the invention, the granules are conveyed in the horizontal leg for a distance 80 that is at least ¼ of the diameter of the rear roller 40. In another embodiment, the distance is at least ½ of the diameter of the rear roller.

Figure 3:
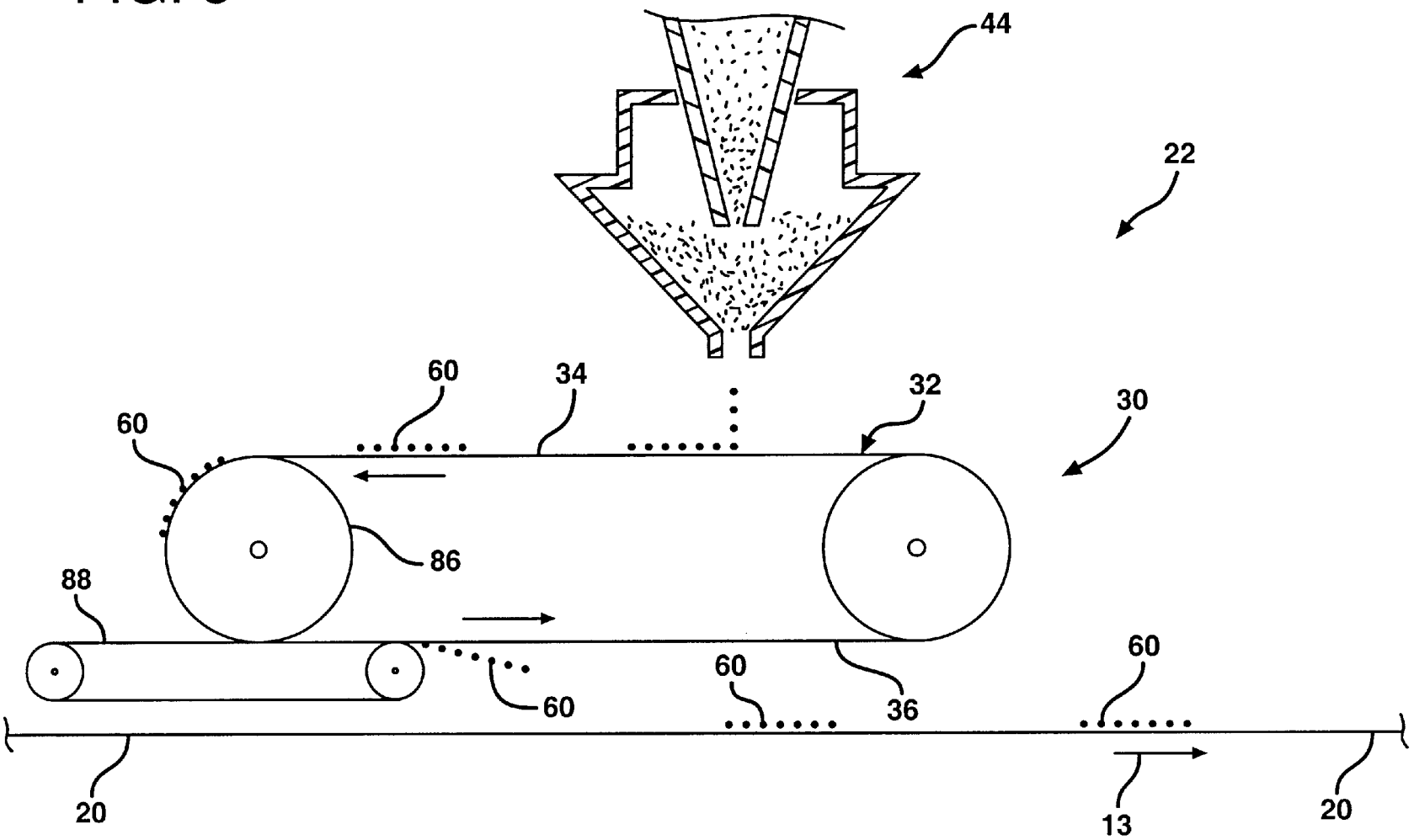
FIG. 3 is a schematic view in elevation of another embodiment of the invention.

As shown in FIG. 3, in an alternate embodiment of the invention, different alignment preserving mechanisms can be used to retain the granules of the blend drops 60 in contact with the blend drop belt 32. The rear roller 86 of the blend drop conveyor 30 can be provided with a vacuum system, not shown, or a magnetic system, not shown, that holds the granules of the blend drop in contact with the rear roller 86 while the conveyor belt 32 is turning around the rear roller 86. Beneath the rear roller 86 an extension conveyor 87 intercepts the blend drop and conveys the blend drop in the machine direction while maintaining the blend drop in contact with the blend drop belt 32. In addition to the vacuum and magnetic alignment preserving mechanisms described above, a chute or shroud, not shown, can be used. It can be seen that the alignment preserving mechanism can be independent and distinct from the apparatus that conveys the blend drop in the machine direction.

Although only one source of blend drop granules is shown in FIGS. 1–3 (i.e., blend drop applicator 44), the method of the invention can employ several blend drop depositing mechanisms so that blend drops of several different colors or shades can be dropped onto the upper flight 34 according to any desired pattern. Also, although the embodiments of the invention illustrated in FIGS. 1–3 above use a pneumatically controlled granule applicator 44 as the blend drop apparatus for creating the blend drops on the upper flight 34 of the blend drop conveyor, it is to be understood that many other methods can be employed to form the blend drops 60 on the blend drop conveyor. For example, several methods are disclosed in the above mentioned patent reference to Koschitzky.

Figure 4:
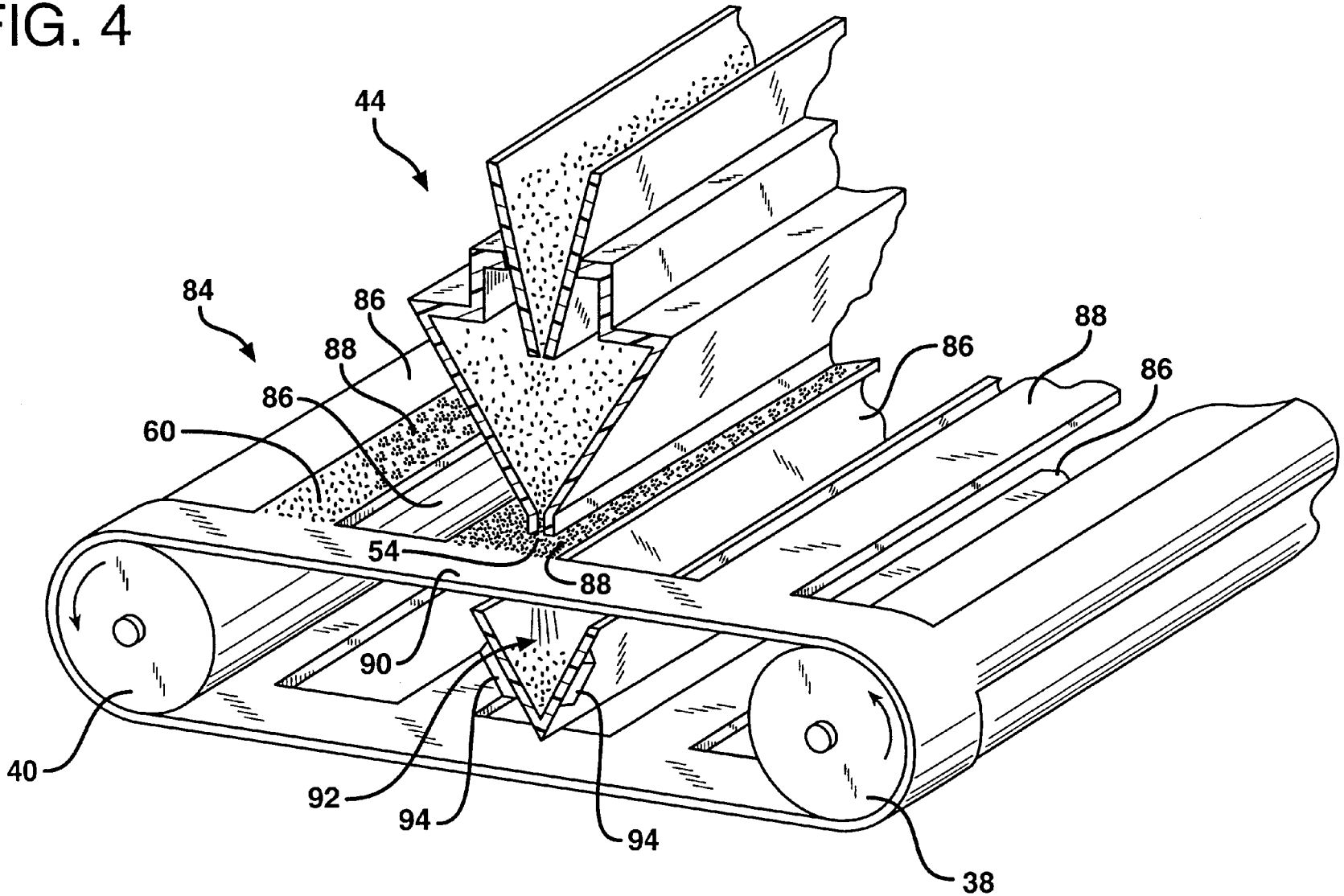
FIG. 4 is a schematic perspective view of an alternate arrangement for creating the blend drops, using a blend drop belt provided with a series of openings spaced apart by a series of panels.

In another embodiment of the invention, an alternate arrangement for creating the blend drops is shown in FIG. 4. A blend drop belt 84 is provided with a series of openings, shown as rectangular openings 86 that are spaced apart by a series of panels 88. A continuous edge strip 90 supports the belt 84 and enables it to be propelled around the forward roller 38 and the rear roller 40. The blend drop applicator 44 drops a curtain 54 of granules 52. The granules that land on one of the panels 88 form a blend drop 60 that is carried around the rear roller 40 and deposited on the asphalt coated sheet 20 in the manner described above with respect to FIGS. 1–3, or in any other suitable manner. The granules that drop onto or through the openings 86 in the belt 84 are collected by any suitable means, such as by a V-belt conveyor 92 positioned beneath the upper flight of the belt 84, and supported by a series of rollers 94. It is to be understood that the alignment preserving conveyor illustrated in FIG. 2, or any other means of maintaining the blend drop granules in alignment with the belt 84, can be used in conjunction with the embodiment shown in FIG. 4.

Figure 5:
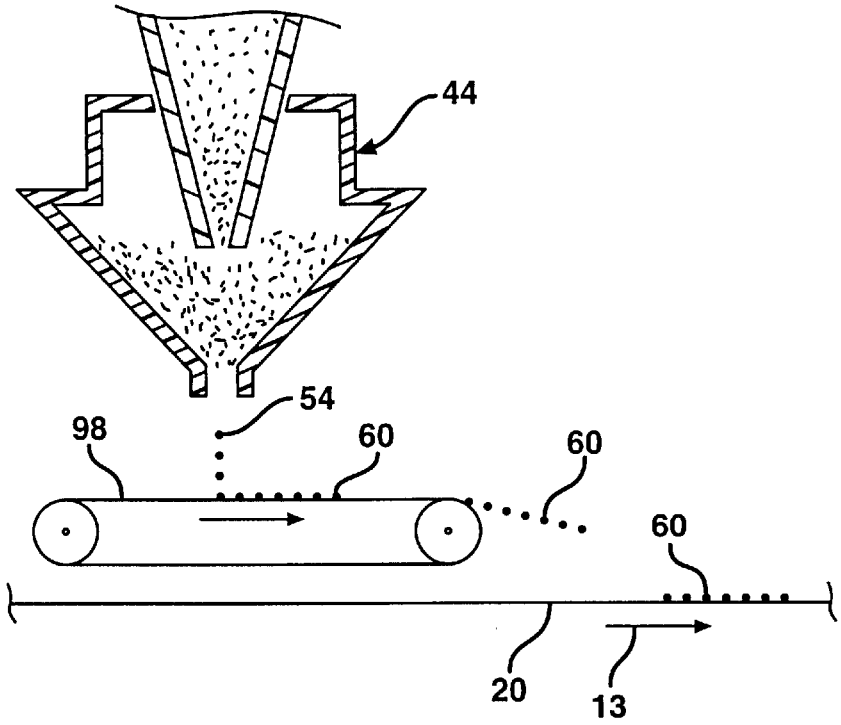
FIG. 5 is a schematic view in elevation of a different embodiment of the invention, including a horizontally oriented belt for delivering the blend drop granules to the asphalt coated sheet.

As shown in FIG. 5, the method of applying blend drop granules to the asphalt coated sheet does not necessarily require that the granules be deposited on an upper flight of a conveyor belt and then wrapped around the rear roller with an alignment mechanism. In FIG. 5, a belt 98 is positioned beneath the blend drop applicator 44, which drops a stream 54 of granules to form blend drops 60.

The belt 96 is generally horizontal in orientation, and is configured so that the blend lo drops move in the machine direction 13. The blend drops 60 are released from the belt 96 and deposited on the asphalt coated sheet 20 to form the blend drops 60 on the sheet. It is to be understood that the embodiment illustrated in FIG. 5 could also use an alternate means for creating the blend drops on the conveyor 98. For example, the belt 84 (traveling in the machine direction) and the other apparatus shown in FIG. 4 could be used to form the blend drops 60.

Figure 6:
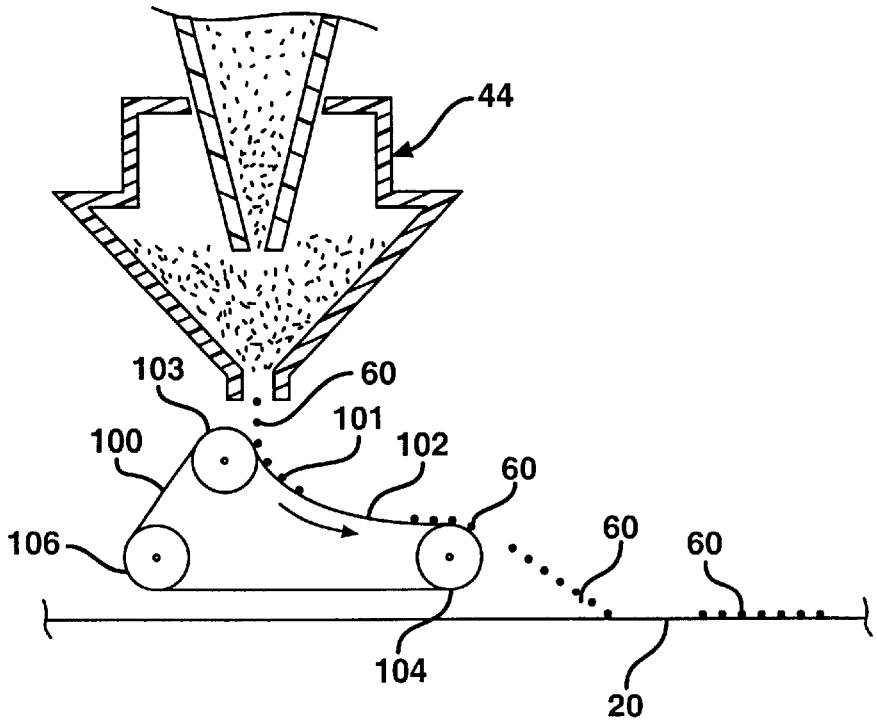
FIG. 6 is a schematic view in elevation of yet another embodiment of the invention, showing the blend drop applicator positioned to deposit a blend drop of granules using a curved belt.
Figure 7:
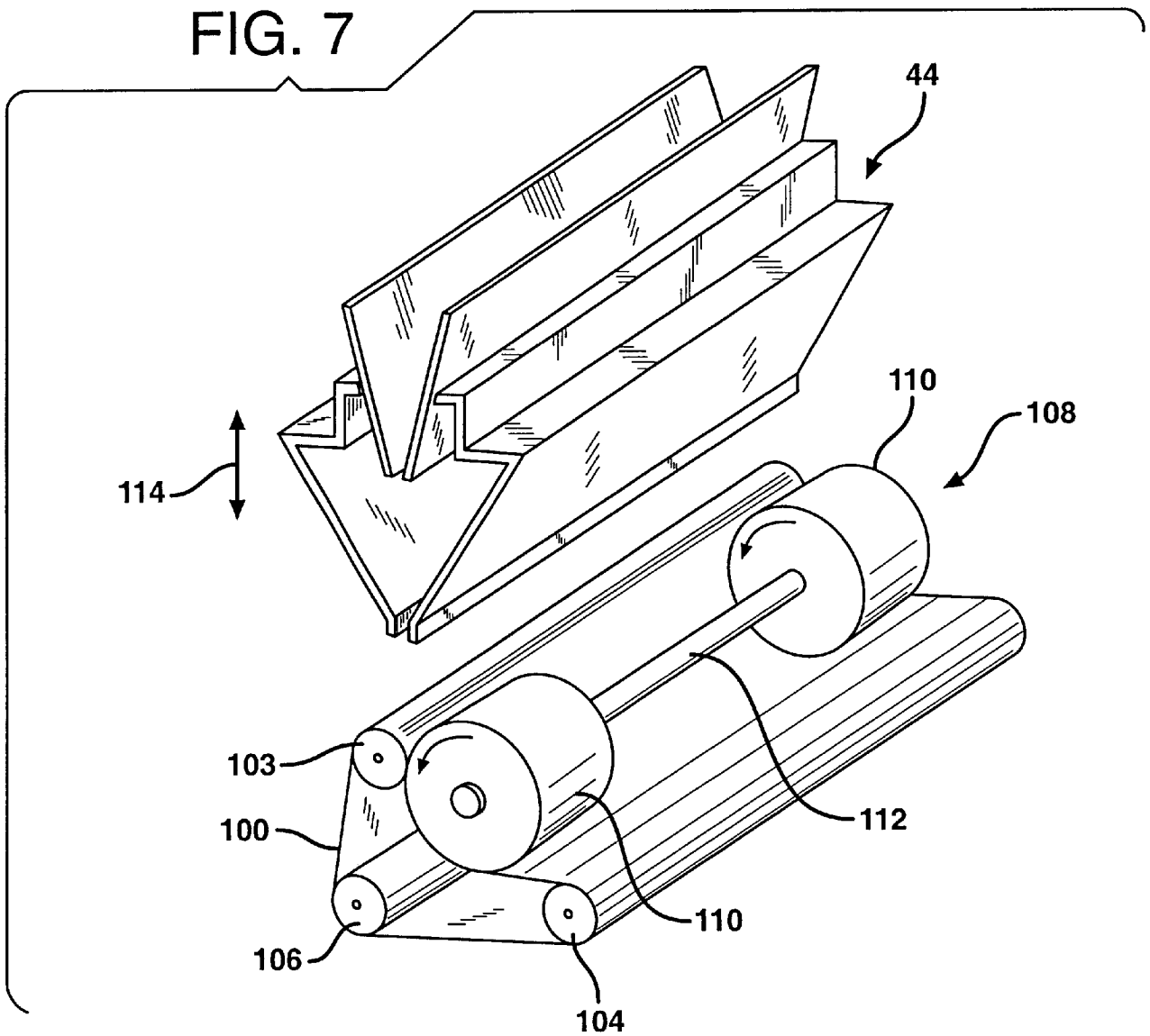
FIG. 7 is a perspective view of the apparatus of FIG. 6, also showing a split drum roller to maintain the curvature of the curved belt.

As shown in FIGS. 6 and 7, in another embodiment of the invention, the blend drop applicator 44 can be positioned to generate a vertically moving blend drop of granules that is directed into contact with a curved belt 100. The curved belt has a generally vertically oriented upper portion 101 and a generally horizontal lower portion 102. As the blend drop granules fall toward the curved belt 100 they are travelling in a direction that is roughly tangent to the upper part of the belt. Therefore, the blend drop granules gently come into contact with the curved belt 100 and then smoothly follow the curve of the belt 100. The curved belt 100 is mounted to rotate around the curved belt alignment roller 103, release roller 104 and return roller 106. The curved belt 100 can be operated at any speed, but preferably the belt is moving a linear speed substantially equal to the speed of the asphalt coated sheet 20. Although the blend drop granules contact the belt 100 in a tangent direction, it is to be understood that the granules can contact the belt at a low angle, such as an angle within the range of from about 0 to about 30 degrees, with respect to the curved belt. The greater the angle of contact or incidence with the belt, the higher the likelihood of granule scatter.

The curvature of the curved belt 100 is maintained or defined by split drum roller 108, which includes spaced apart rotatably mounted drums 110. The drums 110 rotate as a unit, and can be connected by a shaft 112 or any other means, and can be mounted for rotation in any suitable manner. For purposes of clarity, the split drum roller 108 is not shown in FIG. 6, and the granules are not shown in FIG. 7. The drums 110 contact the belt 100 at the outside or lateral edges of the belt to maintain the curvature of the belt. The open space between the spaced apart drums 110 enables the granules to flow along or ride on the belt without interference from the drums 110.

One of the advantages of the embodiment illustrated in FIGS. 6 and 7 is that the granules flowing from the blend drop applicator can be traveling at substantially the speed of the curved belt 100, and hence substantially at the speed of the asphalt coated sheet 20, thereby minimizing the scattering or bouncing of the granules. The granules never come into contact with a moving sheet that is traveling at a speed substantially different from the speed of the granules. After the blend drop granules exit the blend drop applicator 44, they accelerate due to gravity. By positioning the blend drop applicator 44 at the correct height above the curved belt 100, the downward speed of the granules at the time they are intercepted by the belt 100 can be predetermined. In order to accommodate changes in line speed for the asphalt coated sheet, the blend drop applicator 44 can be mounted for vertical adjustment, as indicated by directional arrow 114. Raising the blend drop applicator 44 increases the distance for acceleration, thereby increasing the ultimate granule speed. Alternatively, the curved belt 100 and the split drum roller 108, rather than the blend drop applicator 44, can be mounted for vertical adjustment.

The principle and mode of operation of this invention have been described in its preferred embodiments. However, it should be noted that this invention may be practiced otherwise than as specifically illustrated and described without departing from its scope.

What is claimed is:

1. Apparatus for applying blend drop granules to an asphalt coated sheet comprising:

a blend drop conveyor for receiving blend drop granules, the blend drop conveyor being positioned above an asphalt coated sheet traveling in a machine direction, the blend drop conveyor having an upper flight moving in a direction opposite the machine direction and a lower flight moving in the machine direction;

an alignment preserving mechanism for moving the blend drops from the upper flight to the lower flight of the blend drop conveyor while retaining the blend drops in contact with the blend drop conveyor; and a conveyor having a generally horizontal leg for conveying the blend drops in the machine direction while maintaining the blend drops in contact with the blend drop conveyor, and for releasing the blend drops onto the asphalt coated sheet, the blend drop conveyor being adapted to release the blend drops in the machine direction.

2. The apparatus of claim 1 in which the conveyor for conveying the blend drops in the machine direction conveys the blend drop granules in a plane substantially parallel to the asphalt coated sheet.

3. The apparatus of claim 1 in which the blend drop conveyor is mounted to travel around a rear roller positioned between the upper flight and the lower flight of the blend drop conveyor, and in which the alignment preserving mechanism is a conveyor belt that wraps partially around the rear roller to maintain the blend drops in contact with the blend drop conveyor.

4. The apparatus of claim 1 in which the blend drop conveyor is mounted to travel around a rear roller positioned between the upper flight and the lower flight of the blend drop conveyor, and in which the conveyor for conveying the blend drops in the machine direction is adapted to convey the blend drops in contact with the blend drop conveyor for distance of at least one-half the diameter of the rear roller while maintaining the blend drops in contact with the blend drop conveyor.

5. The apparatus of claim 1 including a pneumatically assisted blend drop applicator adapted to deposit blend drops on the blend drop conveyor.

6. The apparatus of claim 1 in which the conveyor for conveying the blend drops in the machine direction and the alignment preserving mechanism are a single conveyor.

7. The apparatus of claim 6 in which the conveyor for conveying the blend drops in the machine direction conveys the blend drop granules in a plane substantially parallel to the asphalt coated sheet.

8. The apparatus of claim 6 in which the blend drop conveyor is mounted to travel around a rear roller positioned between the upper flight and the lower flight of the blend drop conveyor, and in which the alignment preserving mechanism is a conveyor belt that wraps partially around the rear roller to maintain the blend drops in contact with the blend drop conveyor.

9. The apparatus of claim 6 in which the blend drop conveyor is mounted to travel around a rear roller positioned between the upper flight and the lower flight of the blend drop conveyor, and in which the conveyor for conveying the blend drops in the machine direction is adapted to convey the blend drops in contact with the blend drop conveyor for distance of at least one-half the diameter of the rear roller while maintaining the blend drops in contact with the blend drop conveyor.

10. The apparatus of claim 6 including a pneumatically assisted blend drop applicator adapted to deposit blend drops on the blend drop conveyor.

11. Apparatus for applying blend drop granules to an asphalt coated sheet comprising:

a blend drop applicator for generating vertically moving blend drops of granules; and a curved conveyor positioned to intercept the vertically moving blend drops of granules and change the direction of the blend drops to a generally horizontal orientation as the blend drops move along the curved conveyor, the curved conveyor being adapted to release the blend drops in a substantially horizontal orientation onto the asphalt coated sheet.

12. The apparatus of claim 11 wherein the curved conveyor includes a generally vertically oriented upper portion and a generally horizontal lower portion, and wherein the generally vertically oriented upper portion is oriented to be roughly tangent to the blend drops that are generated by the blend drop applicator.

13. The apparatus of claim 11 in which the blend drop applicator is a pneumatically assisted blend drop applicator.

14. The apparatus of claim 11 including a split drum roller for maintaining the curvature of the curved conveyor, the split drum roller having spaced apart rotatably mounted drums.

15. Apparatus for applying blend drop granules to an asphalt coated sheet comprising:

a blend drop conveyor for receiving blend drop granules, the blend drop conveyor being positioned above an asphalt coated sheet traveling in a machine direction, the blend drop conveyor having an upper flight moving in a direction opposite the machine direction and a lower flight moving in the machine direction;

an alignment preserving mechanism for moving the blend drops from the upper flight to the lower flight of the blend drop conveyor while retaining the blend drops in contact with the blend drop conveyor; and a conveyor for conveying the blend drops in the machine direction and in a plane substantially parallel to the asphalt coated sheet while maintaining the blend drops in contact with the blend drop conveyor, and for releasing the blend drops onto the asphalt coated sheet, the blend drop conveyor being adapted to release the blend drops in the machine direction.

16. The apparatus of claim 15 in which the blend drop conveyor is mounted to travel around a rear roller positioned between the upper flight and the lower flight of the blend drop conveyor, and in which the alignment preserving mechanism is a conveyor belt that wraps partially around the rear roller to maintain the blend drops in contact with the blend drop conveyor.

17. The apparatus of claim 15 in which the blend drop conveyor is mounted to travel around a rear roller positioned between the upper flight and the lower flight of the blend drop conveyor, and in which the conveyor for conveying the blend drops in the machine direction is adapted to convey the blend drops in contact with the blend drop conveyor for distance of at least one-half the diameter of the rear roller while maintaining the blend drops in contact with the blend drop conveyor.

18. The apparatus of claim 15 including a pneumatically assisted blend drop applicator adapted to deposit blend drops on the blend drop conveyor.

19. The apparatus of claim 15 in which the conveyor for conveying the blend drops in the machine direction and the alignment preserving mechanism are a single conveyor.

20. The apparatus of claim 19 in which the conveyor for conveying the blend drops in the machine direction conveys the blend drop granules in a plane substantially parallel to the asphalt coated sheet.

21. The apparatus of claim 19 in which the blend drop conveyor is mounted to travel around a rear roller positioned between the upper flight and the lower flight of the blend drop conveyor, and in which the alignment preserving mechanism is a conveyor belt that wraps partially around the rear roller to maintain the blend drops in contact with the blend drop conveyor.

22. The apparatus of claim 19 in which the blend drop conveyor is mounted to travel around a rear roller positioned between the upper flight and the lower flight of the blend drop conveyor, and in which the conveyor for conveying the blend drops in the machine direction is adapted to convey the blend drops in contact with the blend drop conveyor for distance of at least one-half the diameter of the rear roller while maintaining the blend drops in contact with the blend drop conveyor.

* * * * *